US006084344A

United States Patent [19]

Kishino et al.

[11] Patent Number: 6,084,344

[45] Date of Patent: Jul. 4, 2000

[54] REDUCED THICKNESS VACUUM CONTAINER WITH GETTER

[75] Inventors: Takao Kishino; Gentaro Tanaka; Shigeo Itoh; Takeshi Tonegawa, all of Mobara, Japan

[73] Assignee: Futaba Denshi Kogyo K.K., Mobara, Japan

[21] Appl. No.: 08/988,065

[22] Filed: Dec. 10, 1997

[30] Foreign Application Priority Data

Dec. 18, 1996 [JP] Japan ..... 8-338417

[51] Int. Cl.[7] ..... H01J 63/04; H01J 17/24

[52] U.S. Cl. ..... 313/495; 313/496; 313/422; 313/553

[58] Field of Search ..... 313/495, 496, 313/422, 563, 562, 560, 553, 552, 497

[56] References Cited

U.S. PATENT DOCUMENTS 5,587,622 12/1996 Mochacsi ..... 313/493

5,635,795 6/1997 Itoh et al. ..... 313/495

5,786,660 7/1998 Clerc ..... 313/495

*Primary Examiner*—Nimeshkumar D. Patel

*Assistant Examiner*—Joseph Williams

*Attorney, Agent, or Firm*—Oblon, Spivak, McClelland, Maier & Neustadt, P.C.

[57] ABSTRACT

A vacuum container capable of arranging a getter member therein while preventing an increase in overall height of an envelope and therefore the vacuum container. An anode substrate on which anode electrodes providing a display section are formed and a cathode substrate on which field emission cathodes are formed are arranged opposite to each other and sealedly joined to each other through an outer periphery thereof, to thereby provide an envelope. The cathode substrate is formed with a through-hole communicating with an interior of the envelope. The through-hole has a getter member received therein. The cathode substrate is provided on a portion of an outer surface thereof at which the through-hole is formed with an evacuation pipe through which the envelope is evacuated.

5 Claims, 7 Drawing Sheets

REDUCED THICKNESS VACUUM CONTAINER WITH GETTER

BACKGROUND OF THE INVENTION

This invention relates to a vacuum container, and more particularly to a vacuum container hermetically sealed and kept at a high vacuum by absorbing gas produced in an envelope of the flat type by a getter.

A vacuum container kept at a high vacuum may be realized in the form of a field emission display (hereinafter referred to as "FED") in which field emission cathodes act as an electron source, by way of example. The FED includes an envelope formed by sealedly joining an anode substrate provided on an inner surface thereof with a display section including phosphors and a cathode substrate provided on an inner surface thereof opposite to the display section of the anode substrate with field emission cathodes to each other through an outer periphery thereof while spacing both substrates from each other at a predetermined interval.

In the FED thus constructed, the anode substrate on which the display section having the phosphors arranged at fine dot pitches is formed and the cathode substrate on which the field emission cathodes are formed each are made of a thin glass plate having a thickness as small as, for example, 2.5 mm and are spaced from each other at an interval as small as 0.2 mm, resulting in the envelope being highly reduced in thickness.

In order to ensure that the FED satisfactorily functions as a display device, it is required that the envelope constructed of the anode substrate and cathode substrate is kept at a high vacuum so as to permit the field emission cathodes to emit electrons with increased efficiency. For this purpose, it is generally constructed in such a manner that the envelope is evacuated to a vacuum as high as, for example, $10^{-6}$ Torr and gas remaining in the envelope is absorbed by a getter member to keep the envelope at a vacuum as high as, for example, $10^{-7}$ Torr.

In the conventional FED, as described above, the interval or gap defined between the anode substrate and the cathode substrate is reduced, to thereby render the envelope highly thin. Unfortunately, such a reduction in thickness of the envelope fails to permit the getter member for absorbing gas remaining in the envelope to be arranged in the envelope.

In order to address the problem, the conventional FED, as shown in FIG. 12 or 13, is so constructed that a getter box is arranged outside the envelope. The getter box has a getter film formed therein by deposition.

More particularly, the FED shown in each of FIGS. 12 and 13 includes an envelope 51 constituted by an anode substrate 52 which is formed on an inner surface thereof with a display section including anode conductors and phosphor layers and a cathode substrate 53 which is formed on an inner surface thereof with field emission cathodes. The anode substrate 52 and cathode substrate 53 are arranged so as to face each other while being positionally deviated from each other in a lateral direction of the envelope and are sealedly fixedly joined to each other through a spacer member 54 formed of an adhesive such as low-melting glass or the like arranged on an outer periphery of the substrates 52 and 53.

The envelope 51 has a side surface of which a part is removed. Also, the side surface of the envelope 51 is formed with an evacuation hole 55 which permits an interior of the envelope 51 communicate with an outside thereof therethrough. Reference numeral 56 designates a getter box which is fixed to a portion of the anode substrate positioned in proximity to the evacuation hole 55 and separate from the envelope 51 and the side surface of the envelope 51, resulting in a getter chamber 57 which communicates with the evacuation hole 55 being defined in the getter box 56.

The getter box 56 is formed with a though-hole 58 communicating with the evacuation hole 55. In the FED shown in FIG. 13, the getter box 56 formed with the through-hole 58 has an evacuation pipe 59 for evacuating the envelope therethrough formed at a portion of an outer surface of a portion thereof facing the cathode substrate 53. The FED shown in FIG. 13 has a plate-like metal lid 60 substituted for the evacuation pipe 59 shown in FIG. 12.

The getter box 56 is provided therein with a getter member 61, so that heating of the getter member 61 leads to vaporization of the getter member, to thereby permit a getter firm to be depositedly formed on an inner surface of the getter chamber 57. This results in the thus-formed getter firm absorbing gas which remains in the envelope 51, to thereby keep the envelope 51 at a vacuum as high as, for example, $10^{-7}$ Torr.

Thus, in the conventional FED shown in each of FIGS. 12 and 13, the getter box 56 is arranged separate from the envelope 51 in a manner to be projected outside the cathode substrate 53 constituting a part of the envelope 51. Unfortunately, such arrangement of the getter box 56 causes a thickness of the FED to be increased by an amount corresponding to a thickness of the getter box 56, so that the thickness-reduced FED fails to exhibit its intrinsic advantage owing to a reduction in thickness thereof. More specifically, the envelope 51 is formed into a thickness of 2.5 mm, whereas the getter box is formed into a thickness as large as 7 mm.

Also, the getter box 56 is arranged in a manner to extend between the anode substrate 52 and the cathode substrate 53 which are positionally deviated from each other, so that a closed space communicating with the evacuation hole 55 of the envelope 51 may be formed therein. This renders a configuration of the FED complicated, renders processing or working thereof troublesome and causes an increase in manufacturing cost thereof.

Further, evacuation of the envelope 51 gives rise to outward discharge of gas in the envelope 51 through the evacuation hole 55, as well as through the getter box 56 projected from the envelope 51, so that an evacuation path length is substantially increased due to arrangement of the getter box 56 outside the envelope 51. This results in a flow resistance of the gas occurring during the evacuation being increased, so that much time is required for evacuating the envelope 51 to a high vacuum desired.

SUMMARY OF THE INVENTION

The present invention has been made in view of the foregoing disadvantage of the prior art.

Accordingly, it is an object of the present invention to provide a vacuum container which is capable of permitting arrangement of a getter therein while preventing an increase in overall height of an envelope.

It is another object of the present invention to provide a vacuum container which is capable of eliminating troublesome processing or working for arrangement of a getter therein, to thereby reduce a manufacturing cost of the vacuum container.

It is a further object of the present invention to provide a vacuum container which is capable of reducing a flow resistance of gas occurring during evacuation of an envelope, leading to a reduction in time required for the evacuation.

In accordance with the present invention, a vacuum container is provided. The vacuum container includes two substrates arranged in a manner to be opposite to each other and be spaced from each other at a predetermined interval and sealedly joined to each other through an outer periphery thereof, to thereby provide an envelope hermetically sealed. Any one of the substrates is formed with at least one through-hole communicating with an interior of the envelope. The vacuum container also includes a getter member of which at least a part is received in the through-hole. Then, the through-hole is sealedly closed.

In a preferred embodiment of the present invention, the through-hole functions also as an evacuation hole through which the interior of the envelope is evacuated. The through-hole is provided thereon with one of an evacuation pipe and a lid member.

Also, in accordance with the present invention, a vacuum container is provided. The vacuum container includes two substrates arranged in a manner to be opposite to each other and be spaced from each other at a predetermined interval and sealedly joined to each other through an outer periphery thereof, to thereby provide an envelope hermetically sealed. The outer periphery is formed at a part thereof with a through-hole. At least one of the substrates is formed with a non-facing section which does not face the other of the substrate. The non-facing section of the one substrate is provided thereon with a plate member including a through section which communicates with an interior of the envelope and formed into a thickness substantially identical with the substrate. The vacuum container also includes a getter of which a part is received in the through section. The through section is sealedly closed.

In a preferred embodiment of the present invention, the through section comprises one of a cutout formed on a side surface of the plate member and a through-hole formed via the plate member.

In a preferred embodiment of the present invention, the through section functions also as an evacuation hole and is provided thereon with one of an evacuation pipe and a lid member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
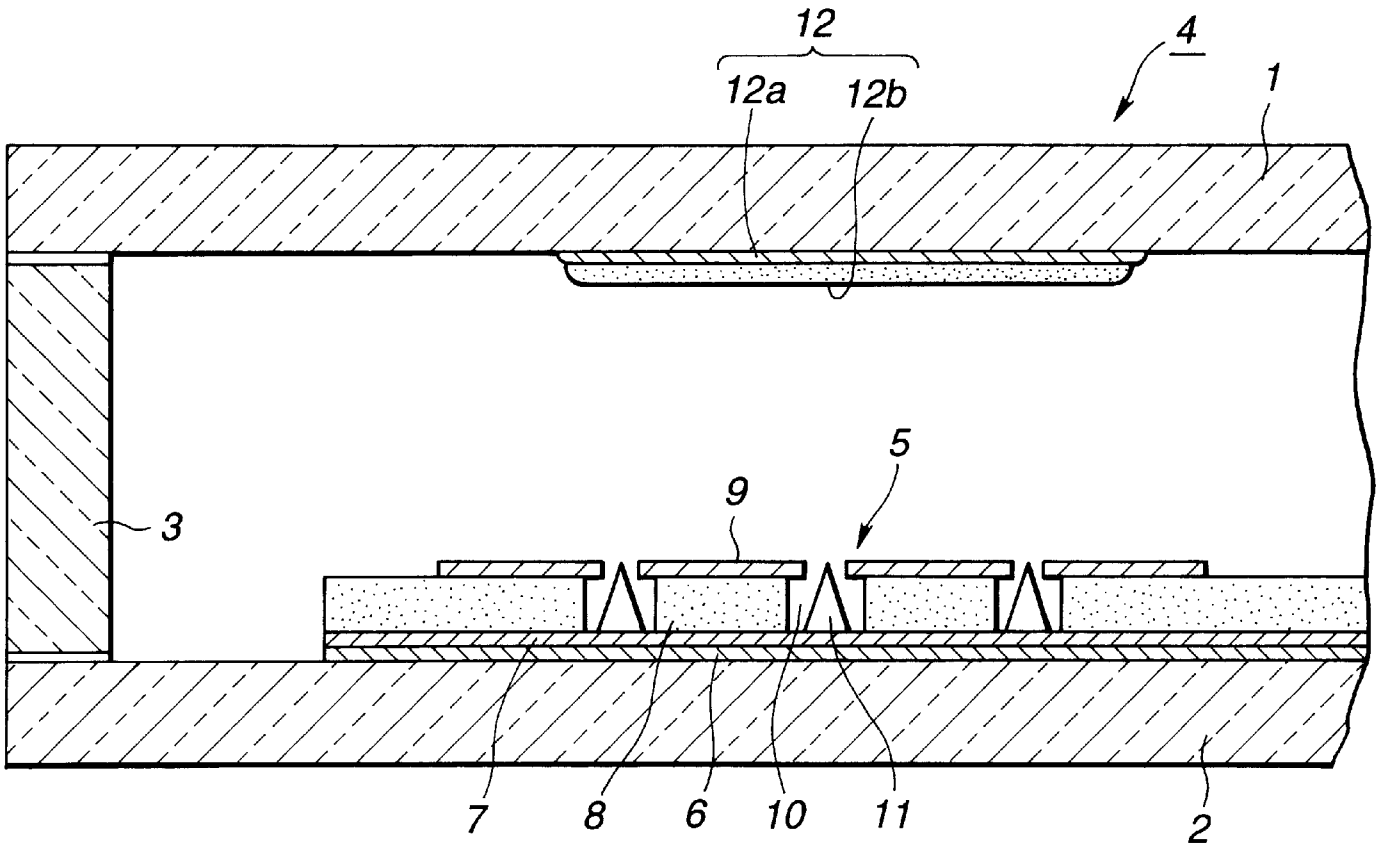
FIG. 1 is a fragmentary side elevation view in section showing an FED to which a vacuum container of the present invention may be applied by way of example.

Now, a vacuum container according to the present invention will be described hereinafter with reference to FIGS. 1 to 11, wherein like reference numerals generally designate like or corresponding parts throughout.

Referring first to FIG. 1, an FED to which a vacuum container of the present invention may be applied is illustrated by way of example. The FED, as shown in FIG. 1, includes a thickness-reduced box-like envelope 4 formed by sealedly joining an insulating and light-permeable anode substrate 1 and an insulating cathode substrate 2 to each other through an insulating spacer member 3 made of an adhesive such as, for example, low-temperature glass or the like. The anode substrate 1 and cathode substrate 2 are arranged so as to be spaced from each other with a gap as small as, for example, about 0.2 mm being defined therebetween.

The cathode substrate 2 is formed on an inner surface thereof opposite to an inner surface of the anode substrate 1 with field emission elements or field emission cathodes 5 of the vertical type acting as an electron source for a display section. The field emission cathodes 5 each include a cathode electrode 6 arranged on the inner surface of the cathode substrate 2, a resistive layer 7 formed on the cathode electrode 6, an insulating layer 8 made of silicon oxide or the like and formed on the resistive layer 7, a gate electrode 9 formed on the insulating layer 8, and emitters 11 of a conical shape each arranged in each of holes 10 commonly formed through both insulating layer 8 and gate electrode 9 while being placed on the resistive layer 7.

The anode substrate 1 is formed on the inner surface thereof positioned in the envelope 4 and facing the inner surface of the cathode substrate 2 with anode electrodes 12 each acting as a display section in a manner to face each of the field emission cathodes 5. The anode electrode 12 each include a light-permeable anode conductor 12*a* arranged on the anode substrate 1 and a phosphor layer 12*b* deposited on the anode conductor 12*a*.

In the FED thus constructed, when the field emission cathode 5 emits electrons, the electrons are caused to be impinged on the phosphor layer 12*b* of the anode electrode 12, leading to excitation of the phosphor layer 12*b* for luminescence. The luminescence of the phosphor layer 12*b* thus obtained is observed through the anode conductor 12*a* and light-permeable anode substrate 1.

Figure 2:
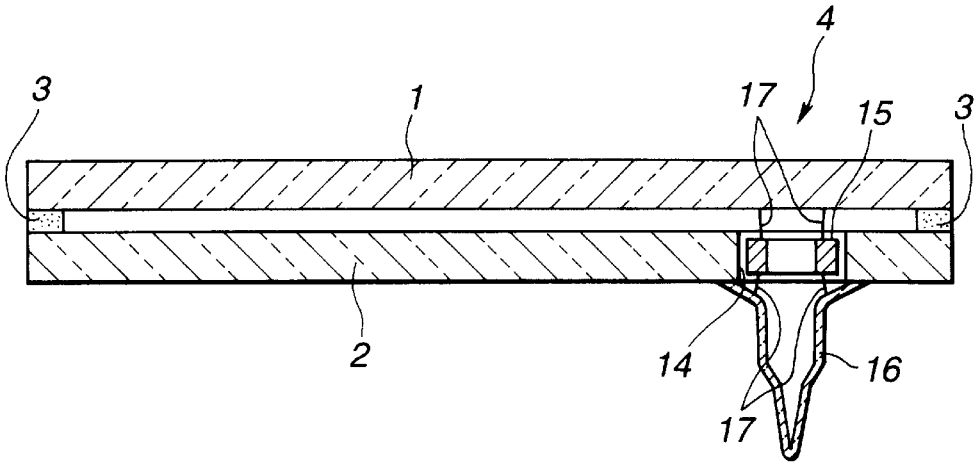
FIG. 2 is a sectional side elevation view showing a first embodiment of a vacuum container according to the present invention.

Referring now to FIG. 2, a first embodiment of a vacuum container according to the present invention is illustrated. In a vacuum container of the illustrated embodiment, a cathode substrate 2 is formed at one end thereof with a through-hole 14 of, for example, a circular shape in section so as to communicate with an interior or inner space of an envelope 4. In the illustrated embodiment, the through-hole 14 is arranged at a right side end portion of the cathode substrate 2. The through-hole 14 has a getter member 15 of a ring-like shape received therein for absorbing gas remaining in the envelope 4, so that the getter member 15 may be installed in a thickness of the cathode substrate 2.

Thus, the through-hole 14 acts to provide a getter chamber for receiving the getter member 15 therein. The cathode substrate 2 is provided on a portion of an outer surface thereof at which the through-hole 14 is positioned with an evacuation pipe 16. The through-hole 14 may be formed into any suitable shape other than a circular shape.

The getter member 15 is fixedly supported on an anode substrate 1 and the evacuation pipe 16 by means of a getter support 17 which may be made of, for example, a leaf spring. The through-hole 14 also functions as an evacuation hole through which the gas in the envelope 4 is discharged from the evacuation pipe 16.

Figure 3:
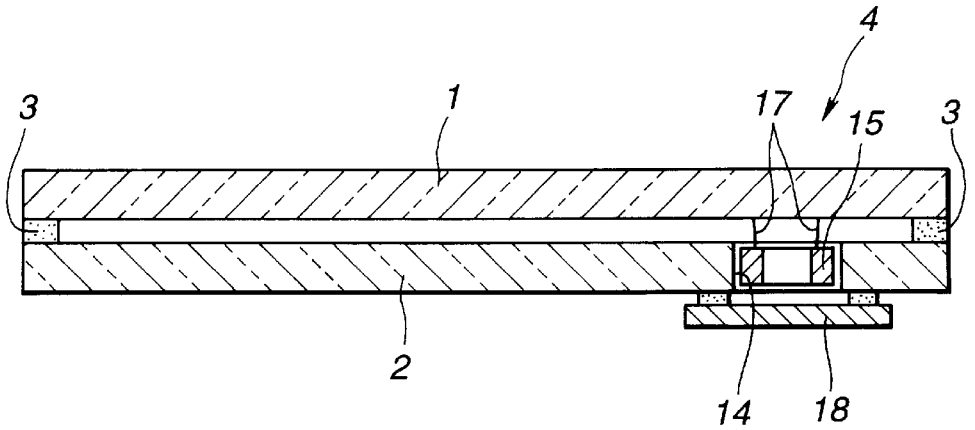
FIG. 3 is a sectional side elevation view showing a second embodiment of a vacuum container according to the present invention.

Referring now to FIG. 3, a second embodiment of a vacuum container according to the present invention is illustrated. A vacuum container of the illustrated embodiment includes a lid member 18 substituted for the evacuation pipe 16 arranged on the vacuum container of the first embodiment described above. The lid member 18 is made of a glass plate or a metal plate and arranged so as to cover a through-hole 14 to close it after an envelope 4 is evacuated. The through-hole 14 has a getter member 15 installed therein, which is fixedly supported on an anode substrate 1 by means of a getter support 17. The remaining part of the second embodiment may be constructed in substantially the same manner as the first embodiment described above. The second embodiment thus constructed permits a portion of the envelope 4 in which the getter member 15 is received to be decreased in thickness as compared with the first embodiment, resulting in an overall thickness of the vacuum container being further reduced.

Figure 4:
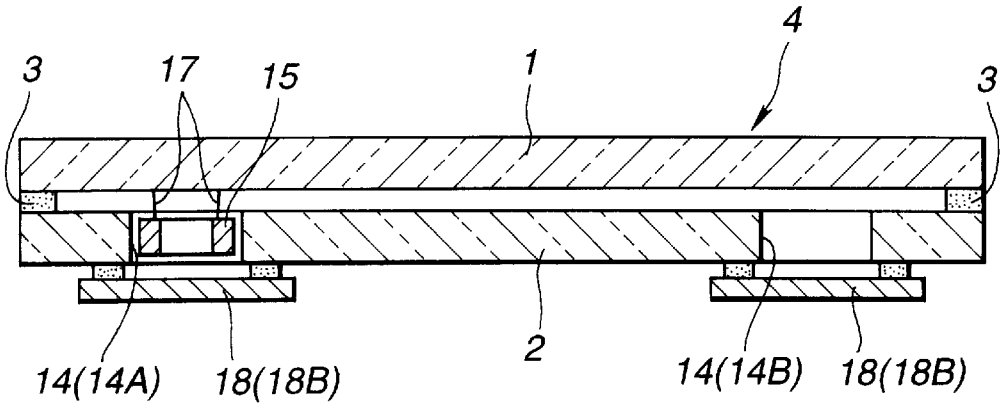
FIG. 4 is a sectional side elevation view showing a third embodiment of a vacuum container according to the present invention.
Figure 5:
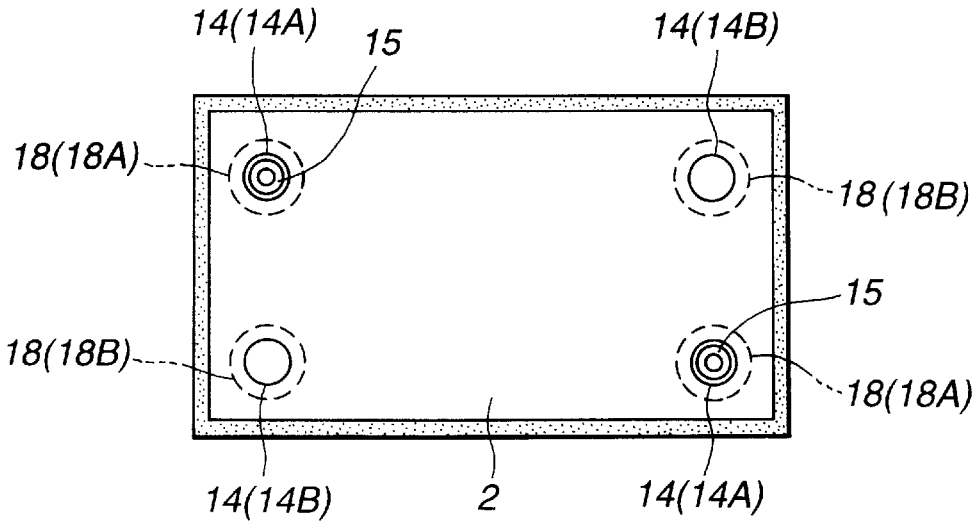
FIG. 5 is a plan view showing a cathode substrate forming a part of the vacuum container of FIG. 4.

Referring now to FIGS. 4 and 5, a third embodiment of a vacuum container according to the present invention is illustrated. A vacuum container of the illustrated embodiment is so constructed that a cathode substrate 2 is formed with a plurality of through-holes 14 (14A, 14B) communicating with an inner space of an envelope 4. In the illustrated embodiment, the through-holes 14 each are arranged at each of four corners of the cathode substrate 2.

In the illustrated embodiment, as shown in FIG. 5, a pair of such through-holes 14A positioned on one of diagonal lines defined on the cathode substrate 2 of a rectangular shape each have a getter member 15 received therein. In the illustrated embodiment, the getter member 15 is arranged in each of the upper-left and lower-right through-holes 14A in FIG. 5. The cathode substrate 2 is provided on a portion of an outer surface thereof at which each of the through-holes 14A is positioned with a lid member 18A for selectively covering the through-holes 14A to close it.

Also, the upper-right and lower-left through-holes 14B positioned on the other diagonal line on the cathode substrate 2 in FIG. 5 each function as an evacuation hole through which gas in an envelope 4 is outwardly evacuated. The through-holes 14B each have a lid member 18B arranged thereon for closing it after the evacuation. Such arrangement of a plurality of such through-holes 14B functioning as the evacuation hole permits the evacuation to be carried out with increased efficiency.

In the illustrated embodiment, as described above, the through-holes 14 formed at the four corners of the cathode substrate 2 are divided into two getter receiving through-holes 14A and two through-holes 14B each acting as the evacuation hole. Alternatively, the number of through-holes 14 may be one or more depending on a side of the envelope 4.

Further, the getter member 15 may be received in any one of the through-holes 14 or at least one of the through-holes 14B functioning as the evacuation hole. Also, in the illustrated embodiment, each of the through-holes 14B acting as the evacuation hole has the lid member 18B fixed thereon. Alternatively, an evacuation pipe may be substituted for the lid member 18B.

Figure 6:
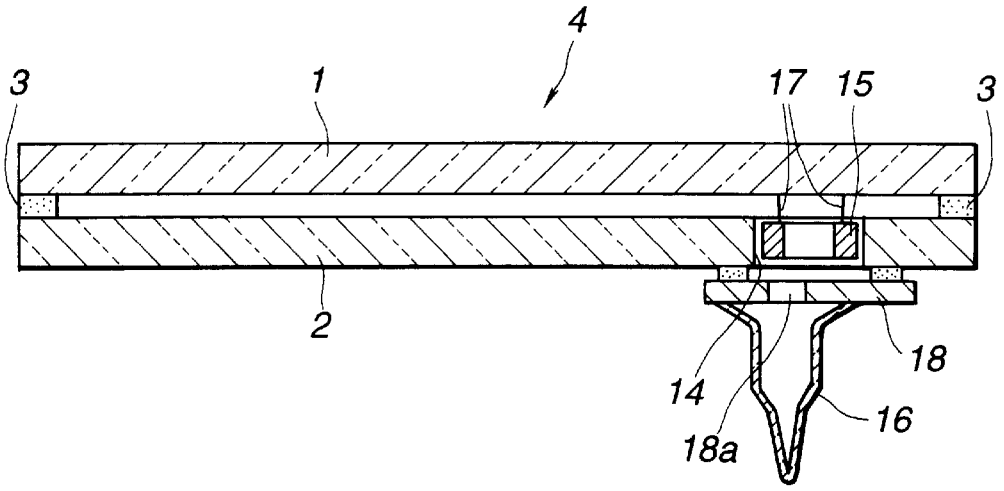
FIG. 6 a sectional side elevation view showing a fourth embodiment of a vacuum container according to the present invention.

Referring now to FIG. 6, a fourth embodiment of a vacuum container according to the present invention is illustrated. A vacuum container of the fourth embodiment may be constructed in substantially the same manner except that a lid member 18 is formed with a through-hole 18*a* communicating with a through-hole 14 and provided thereon with an evacuation pipe 16.

Figure 7:
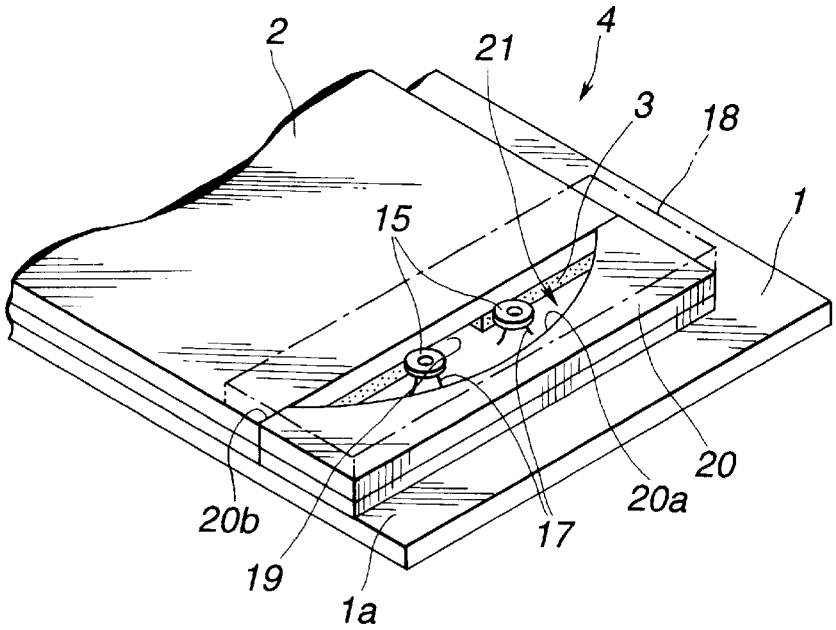
FIG. 7 is a perspective view schematically showing a fifth embodiment of a vacuum container according to the present invention.
Figure 8:
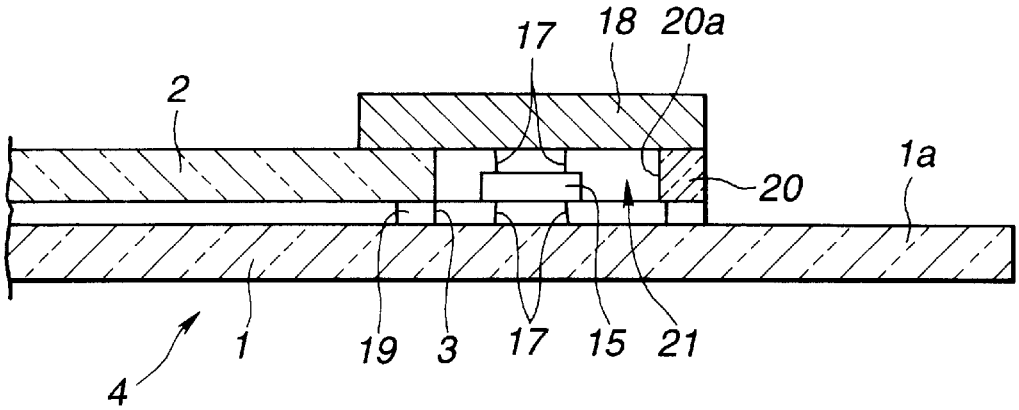
FIG. 8 is a sectional side elevation view of FIG. 7.

Referring now to FIGS. 7 and 8, a fifth embodiment of a vacuum container according to the present invention is illustrated. In a vacuum container of the fifth embodiment, an anode substrate 1 is formed into a width and a length larger than those of a cathode substrate 2, to thereby include a non-facing section 1*a* which does not face the cathode substrate 2 or laterally outwardly extends beyond the cathode substrate 2. The cathode substrate 2 is sealedly joined at an outer periphery to the anode substrate 1 through a spacer member 3. The spacer member 3 is formed at a part thereof with a through-hole 19 communicating with an interior of an envelope 4.

The non-facing section 1*a* of the anode substrate 1 has a plate member 20 fixed thereon. The plate member 20 is made of a glass material like the substrates 1 and 2 constituting the envelope 4 and formed into substantially the same thickness of the cathode substrate. The plate member 20 is formed at an intermediate portion of a side surface thereof facing the cathode substrate 2 with a cutout 20*a* of a bow-like shape, so that the side surface is provided both ends thereof with flat surface portions 20*b* between which the cutout 20*a* is interposed.

The thus-formed plate member 20 is fixedly mounted on the anode substrate 1 while keeping the flat surface portions 20*b* abuttedly contacted with a side end surface of each of the cathode 2 and spacer member 3 so that the cutout 20*a* forms a bowlike space 21 communicating with the through-hole 19. The space 21 is provided therein two ring-like getter members 15 in a manner to be juxtaposed to each other.

A lid member 18 is arranged on the cathode substrate 2 and plate member 20 so as to extend therebetween and cover the space 21, to thereby close the space 21. The getter member 15 is fixedly supported on the anode substrate 1 and lid member 18 by means of a getter support 17.

Figure 9:
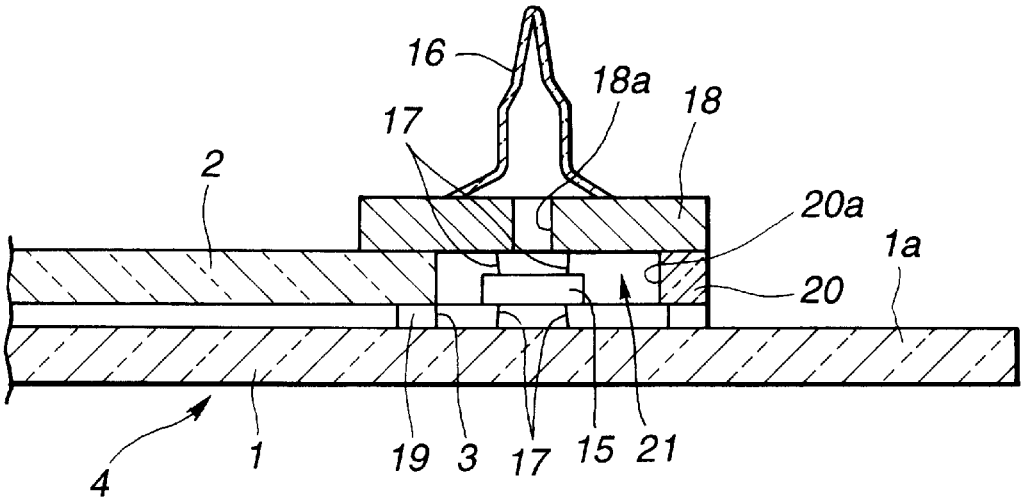
FIG. 9 is a sectional side elevation view showing a six embodiment of a vacuum container according to the present invention.

Referring now to FIG. 9, a sixth embodiment of a vacuum container according to the present invention is illustrated. A vacuum container of the illustrated embodiment is provided with a lid 18 and a space 21, which are constructed like those in the fifth embodiment described above, wherein the lid 18 is formed with a through-hole 18*a* communicating with the space 21. The lid member 18 is provided thereon with an evacuation pipe 16. The remaining part of the sixth embodiment may be constructed in substantially the same manner as the fifth embodiment.

Figure 10:
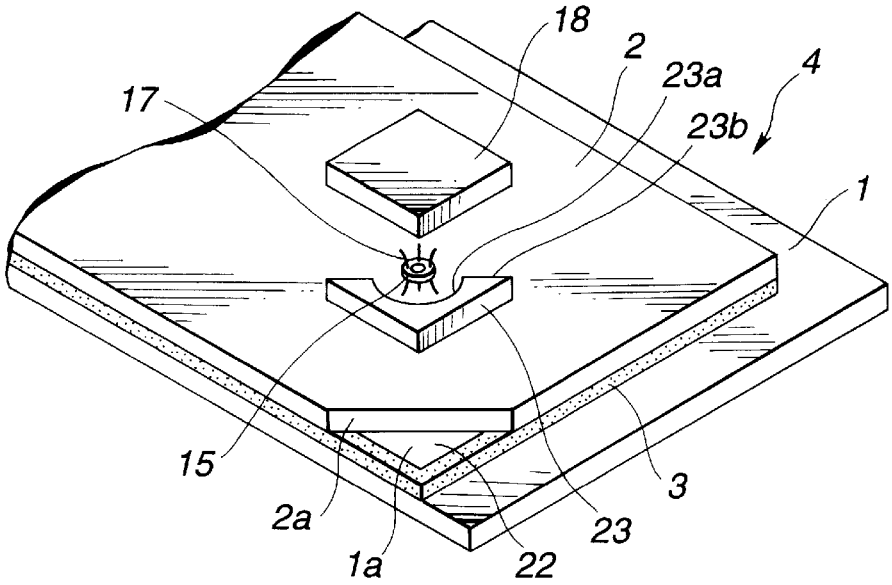
FIG. 10 is a perspective view showing a seventh embodiment of a vacuum container according to the present invention.

Referring now to FIG. 10, a seventh embodiment of a vacuum container according to the present invention is illustrated. In a vacuum container of the illustrated embodiment, a cathode substrate 2 is cut out at one of corners thereof into a triangle shape, so that an anode substrate 1 is provided with a non-facing section 1*a* which does not face the cathode substrate 2 or laterally outwardly extends beyond the cathode substrate 2. The corner portion thus cut out is formed with a cut surface 2*a* vertically extending. In the illustrated embodiment, the corner of the cathode substrate is cut out into an isosceles right triangle. A spacer member 3 is arranged in a frame-like manner along an outer periphery of the cathode substrate 2 and is formed at an exposed corner portion thereof defined by the cut-out corner portion of the cathode substrate 2 with a triangular hole 22 communicating with an interior of an envelope 4.

The spacer member 3 is fixedly mounted on the exposed corner portion thereof with a plate member 23 of a triangular shape in such a manner that the plate member is abutted at a base 23*b* thereof against the cut surface 2*a* of the cathode substrate 2. In the illustrated embodiment, the plate member 23 is formed into an isosceles right triangle. The plate member 23 may be made of, for example, a glass material like those of substrates 1 and 2 constituting the envelope 4 and formed into substantially the same thickness as the cathode substrate 2. The plate member 23 is formed on the base or side surface 23*b* thereof contacted with or abutted against the cut-out surface 2*a* of the cathode substrate 2 with a cutout 23*a* of a U-like shape.

The plate member 23*a* is fixed on the spacer member 3 while intimately abutting the base or side surface 23*b* thereof against the cut-out surface 2*a* of the cathode substrate 2 so that the cutout 23*a* forms a space communicating with the hole 22 of the spacer member 3. The space defined by the cutout 23*a* has a getter member 15 of a ring-like shape received therein for absorbing gas remaining in the envelope 4.

The thus-formed space or cutout 23*a* is covered with a lid member 18 arranged on the cathode substrate 2 and plate member 23 so as to extend therebetween, resulting in being closed. The getter member 15 is fixedly supported on the anode substrate 1 and lid member 18 by means of a getter support 17.

Figure 11:
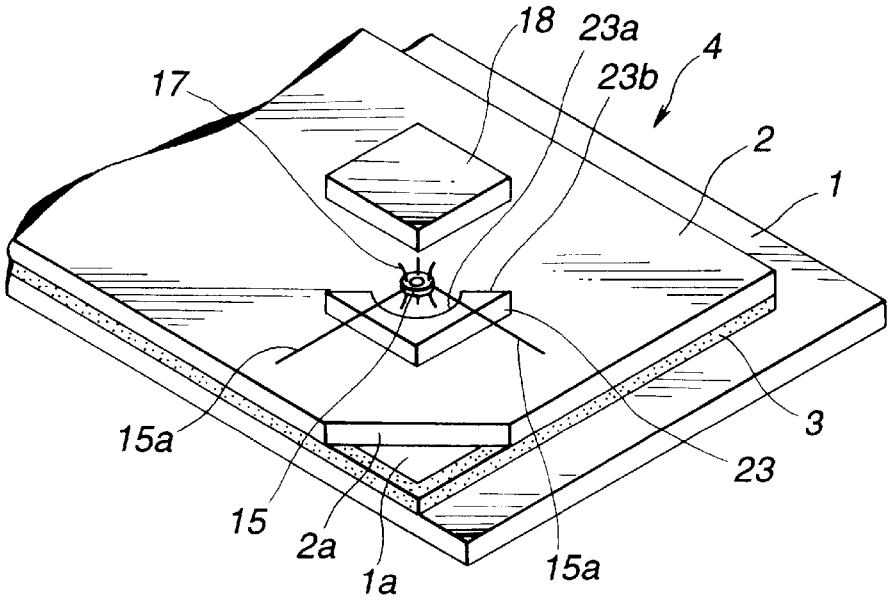
FIG. 11 is a perspective view showing an eighth embodiment of a vacuum container according to the present invention.
Figure 12:
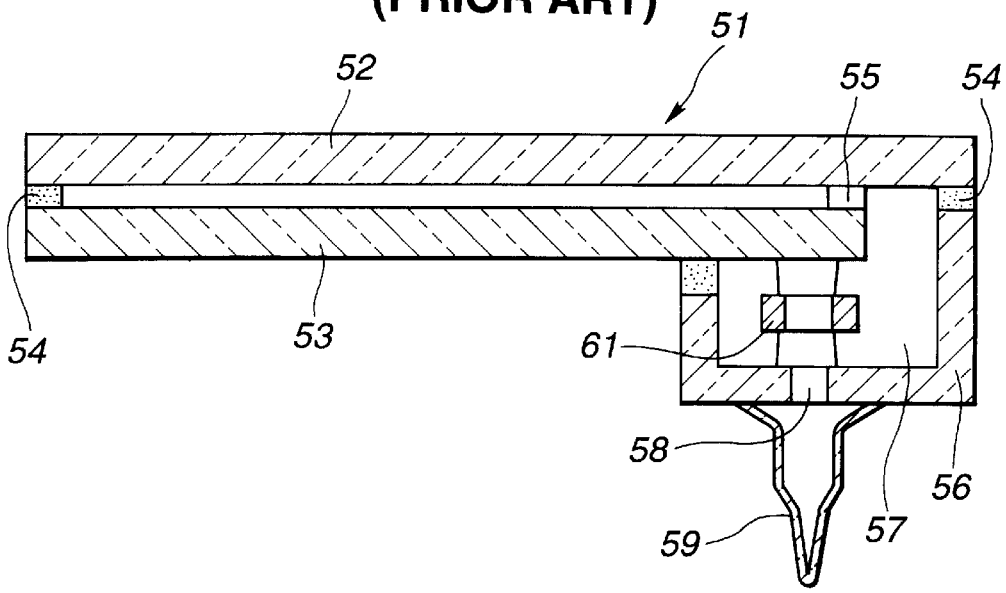
FIG.12 (PRIOR ART)
FIG. 12 is a sectional side elevation view showing an example of a conventional vacuum container.
Figure 13:
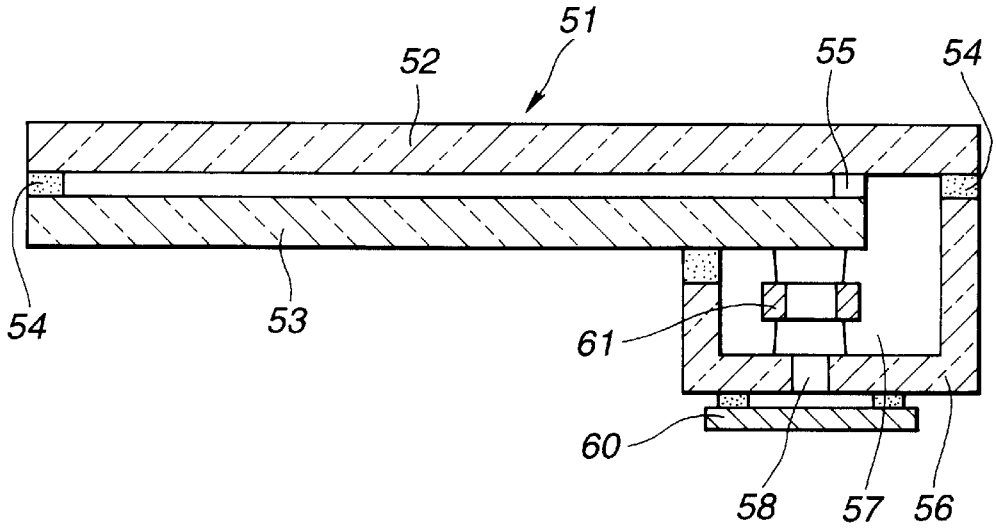
FIG.13 (PRIOR ART)
FIG. 13 is a sectional side elevation view showing another example of a conventional vacuum container.

Referring now to FIG. 11, an eighth embodiment of a vacuum container according to the present invention is illustrated. In a vacuum container of the eighth embodiment, a triangular plate member 23 is formed with a cutout 23*a* in substantially the same manner as the seventh embodiment described above. The cutout 23*a* of the plate member 23 has a getter member 15 received therein. For this purpose, a getter fed with electricity or an electric power is used as the getter member 15. The getter member 15 includes electrodes 15*a*, which are led out of the getter member 15 through a spacer 3 to an exterior of an envelope 4 and then connected to a power supply (not shown), resulting in the getter member 15 being fed with an electric power. The remaining part of the eighth embodiment may be constructed in substantially the same manner as the seventh embodiment described above.

The first to fourth embodiments described above each are so constructed that the cathode substrate 2 is formed with the through-hole 14 communicating with the interior of the envelope 4, in which the getter member 15 is received in the through-hole 14. Such construction permits the getter member 15 to be received in the cathode substrate 2, to thereby prevent an increase in thickness of the envelope 4.

Also, in each of the fifth to eighth embodiments, the anode substrate 1 is provided with the non-facing section 1*a* which does not face the cathode substrate 2 or laterally outwardly extends beyond the cathode substrate 2. Also, the plate member 20 or 23 which is formed separate from the envelope 4 and into substantially the same thickness as the cathode substrate 2 is formed with the cutout 20*a* or 23*a* for receiving the getter member 15 therein. Further, the plate member 20 or 23 is fixed on the non-facing section 1*a* of the anode substrate 1 so as to permit the cutout 20*a* or 23*a* to communicate with the space 21. Thus, each of the embodiments permits the getter member 15 to be received in the cutout 20*a* or 23*a* without causing a thickness of the envelope 4 to be increased, as in the first to fourth embodiments.

Further, the fifth to eighth embodiments each prevent the getter box from being arranged in a manner to be outwardly projected from the envelope, unlike the conventional vacuum container, so that the vacuum container of each embodiment may be reduced in thickness and weight, resulting in an equipment to which the vacuum container is applied being decreased in thickness. Also, it reduces both a material cost of the vacuum container and a transportation cost thereof as compared with the conventional vacuum container. Further, it advantageously reduces an evacuation path length by a distance corresponding to elimination of the getter box, to thereby reduce a flow resistance of gas in the envelope during evacuation of the gas.

In particular, in each of the fifth to eighth embodiments, the plate member 20 or 23 is made separately from the anode substrate 1 and cathode substrate 2 without subjecting both substrates 1 and 2 directly to processing or working and formed with the cutout 20*a* or 23*a* for receiving the getter member 15 therein, which communicates with the interior of the envelope 4. Such construction effectively prevents pollution of the substrates 1 and 2 on which various electrodes are arranged. More specifically, the embodiments eliminate processing or working of the substrates 1 and 2 possibly producing glass powders which adhere to the substrates to fail in satisfactory deposition of a mask for printing of the electrodes during formation of the electrodes by printing, leading to a failure in insulation.

The getter member 15 for absorbing gas remaining in the envelope thereon may be made of any suitable material of the non-vaporization type such as Ti-Zr-Al alloy, Ti-Zr-V-Fe alloy or the like or any suitable material of the vaporization type such as Ba-Al alloy or the like. Alternatively, it may be suitably made of a combination of both materials.

In each of the embodiments described above, the getter chamber for receiving the getter member 15 therein is arranged on a side of the cathode substrate 2. Alternatively, it may be provided on a side of the anode substrate 1. Also, the number of getter members 15 arranged in each of the getter chambers 15 may be varied depending on a size of the getter chamber or the like. Further, the getter member 15 may be formed into any suitable shape such as a bar-like shape or the like other than such a ring-like shape as described above, so long as it may be received in the getter chamber.

In each of the fifth to eighth embodiments, the plate member 20 or 23 is formed with the cutout 20*a* or 23*a* for receiving the getter member 15 therein. The cutout may be replaced with a through-hole formed via the getter member so as to communicate with the interior of the envelope 4.

In addition, in each of the embodiments described above, the getter member 15 is formed into a thickness smaller than that of each of the anode substrate 1 and cathode substrate. Substitutionally, the former may be formed into a thickness larger than the latter. In this instance, a lid member of a box-like shape may be used. This is applied to the case that it is required to maintain a space for forming a getter film by scattering of the getter member. For example, in each of the embodiments shown in FIGS. 2 and 3, the lid member is arranged outside the envelope 4 while facing the through-hole 14. This permits a space provided by the lid member in addition to the through-hole 14 to be utilized as a space for receiving the getter member 15 or forming the getter film.

Moreover, although the above description has been made in connection with the FED by way of example, the vacuum container of the present invention may be likewise applied to, for example, a vacuum micro magnetic sensor, a high-speed switching element, an imaging element, a reader or the like other than the FED, so long as it needs a container of a hermetical structure which is kept at a high vacuum and reduced in thickness.

As can be seen from the foregoing, the present invention permits the getter member to be received in the through-hole or through section, resulting in the envelope being reduced in thickness.

Also, the present invention eliminates any getter box arranged so as to be projected outside the envelope, to thereby accomplish a reduction in thickness and weight of the vacuum container, leading to a reduction in thickness of an equipment to which the vacuum container of the present invention is applied. Also, it attains a reduction in both material and transportation costs of the vacuum container. Further, it permits an evacuation path length to be significantly reduced, leading to a reduction in flow resistance of gas in the evacuation path during evacuation of the envelope, resulting in the vacuum container exhibiting improved characteristics.

Further, the cutout for receiving the getter member therein is formed in the plate member separate from the substrates without subjecting the substrates directly to glass processing and arranged so as to act also as the space communicating with the interior of the envelope. This effectively prevents pollution of the substrates on which the electrodes are arranged.

Furthermore, the through-hole or cutout in which the getter member is received functions also as the evacuation hole through which the envelope is evacuated.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A vacuum container comprising:

two substrates arranged in a manner to be opposite to each other and be spaced from each other at a predetermined interval and sealedly joined to each other through an outer periphery thereof, to thereby provide an envelope hermetically sealed;

said outer periphery being formed at a part thereof with a through-hole;

at least one of said substrates being formed with a non-facing section which does not face the other of said substrate;

said non-facing section of said one substrate being provided thereon with a plate member including a through section which communicates with an interior of said envelope which functions as an evacuation hole through which the interior of said envelope is evacuated and formed into a thickness substantially identical with said substrate; and a ring-shaped getter which is received in a thickness of said through section while keeping a clearance therebetween;

said through section being sealedly closed.

2. A vacuum container as defined in claim 1, wherein said through section comprises one of a cutout formed on a side surface of said plate member and a through-hole formed via said plate member.

3. A vacuum container as defined in claim 2 wherein said through section is provided thereon with one of an evacuation pipe and a lid member.

4. A vacuum container as defined in claim 1, wherein said ring-shaped getter is supported from one of said two substrates by a getter support.

5. A vacuum container as defined in claim 4, wherein said getter support is a leaf spring.

* * * * *